US009771235B2

(12) United States Patent
Oudsen

(10) Patent No.: US 9,771,235 B2
(45) Date of Patent: Sep. 26, 2017

(54) FOLDING MACHINE

(71) Applicant: SDD Holding B.V., Ernst (NL)

(72) Inventor: Johannes Franciscus Roland Oudsen, Epe (NL)

(73) Assignee: SDD Holding B.V., Emst (NL)

( * ) Notice: Subject to any disclaimer, the term of this patent is extended or adjusted under 35 U.S.C. 154(b) by 755 days.

(21) Appl. No.: 13/799,808

(22) Filed: Mar. 13, 2013

(65) Prior Publication Data

US 2013/0252795 A1 Sep. 26, 2013

(30) Foreign Application Priority Data

Mar. 26, 2012 (EP) ..... 12161358

(51) Int. Cl.
*B65H 45/16* (2006.01)
*B65H 45/12* (2006.01)
*B65H 45/18* (2006.01)

(52) U.S. Cl.
CPC ..... *B65H 45/16* (2013.01); *B65H 45/12* (2013.01); *B65H 45/18* (2013.01); *B65H 2701/13212* (2013.01)

(58) Field of Classification Search
None
See application file for complete search history.

(56) References Cited

U.S. PATENT DOCUMENTS 2,066,620 A * 1/1937 Grammer ..... B42B 4/00 281/27.3
2,690,909 A * 10/1954 Bosley ..... B41J 15/16 493/433
4,230,029 A * 10/1980 Schott, Jr. ..... B26D 1/045 493/195
4,568,319 A * 2/1986 Samata ..... B65H 45/18 474/148
5,267,935 A * 12/1993 Bialek ..... B41F 13/56 493/444
5,458,557 A * 10/1995 Bladie ..... B65H 45/18 493/437
5,741,209 A * 4/1998 Hillebrand ..... B41F 13/62 493/356
6,276,677 B1 * 8/2001 Hommochi ..... B65H 45/18 270/32
6,458,066 B1 * 10/2002 Breton ..... B65H 45/167 493/419

(Continued)

FOREIGN PATENT DOCUMENTS

DE 1486444 A1 * 12/2004 ..... B65H 45/18
EP 1486444 A1 12/2004

(Continued)

*Primary Examiner* — Hemant M Desai
*Assistant Examiner* — Mobeen Ahmed
(74) *Attorney, Agent, or Firm* — The Webb Law Firm

(57) ABSTRACT

A folding machine for folding a stack of sheets, the folding machine comprising: a frame; mechanism for pre-folding a stack of sheets along a crease line into a main plane such that a booklet with a straight back is obtained; mechanism for keeping the pre-folded booklet relative to the frame; mechanism for finishing the fold; and a transport plate having a leading edge around which the stack of sheets is folded, the transport plate being movable along the mechanism for pre-folding and the mechanism for finishing the fold.

6 Claims, 2 Drawing Sheets

(56) References Cited

U.S. PATENT DOCUMENTS

| | | | | |
|---|---|---|---|---|
| 6,673,004 | B2 * | 1/2004 | Nanba | B65H 45/164 493/424 |
| 6,692,208 | B1 * | 2/2004 | Watkiss | B65H 45/18 156/479 |
| 7,147,598 | B2 * | 12/2006 | Fujimoto | B65H 29/12 270/45 |
| 7,360,958 | B2 * | 4/2008 | Awano | B26D 1/20 270/58.07 |
| 7,594,645 | B2 * | 9/2009 | Suzuki | B65H 29/12 270/32 |
| 2005/0008460 | A1 * | 1/2005 | Watkiss | B65H 45/18 412/9 |
| 2005/0189689 | A1 * | 9/2005 | Kushida | B65H 37/06 270/37 |
| 2008/0101836 | A1 * | 5/2008 | Fujita | B42C 5/00 399/390 |
| 2008/0101890 | A1 * | 5/2008 | Fujita | B42C 5/00 412/11 |
| 2008/0211159 | A1 * | 9/2008 | Iijima | B42B 4/00 270/37 |
| 2008/0318752 | A1 * | 12/2008 | Oshiro | B65H 45/18 493/424 |
| 2009/0026687 | A1 * | 1/2009 | Sasahara | B65H 45/18 270/37 |
| 2009/0152789 | A1 * | 6/2009 | Kikkawa | B65H 45/18 270/45 |
| 2010/0104399 | A1 | 4/2010 | Ryan | |
| 2010/0133736 | A1 * | 6/2010 | Park | B41L 43/02 270/4 |
| 2012/0046154 | A1 * | 2/2012 | Takeuchi | B65H 45/18 493/405 |

FOREIGN PATENT DOCUMENTS

| | | | |
|---|---|---|---|
| GB | 2401820 | A | 11/2004 |
| JP | 612671 | A | 1/1986 |
| JP | 2006290588 | A | 10/2006 |
| JP | 2010208766 | A | 9/2010 |
| WO | 2004048241 | A1 | 6/2004 |

* cited by examiner

FOLDING MACHINE

BACKGROUND OF THE INVENTION

1. Field of the Invention

The invention relates to a folding machine for folding a stack of sheets, the folding machine comprising:

a frame;

means for pre-folding a stack of sheets along a crease line into a main plane such that a booklet with a straight back is obtained;

means for keeping the pre-folded booklet relative to the frame;

means for finishing the fold.

2. Description of the Related Art

Such a folding machine is for example known from US 20100104399.

For finishing printed paper and press work, it is widely known to feed the sheets to a finishing station. Such a finishing station typically could stack the sheets into a stack of sheets, provide staples to attach the sheets to each other, trim edges and fold the stack of sheets into a booklet.

For folding a stack of sheets into a booklet, a number of techniques are known. An often used technique for folding sheets supplied by a printer is the knife folding technique. The sheets supplied by the printer are stacked and transported near two parallel rollers. A knife blade will then push in the center of the stack, such that the center of the stack of sheets is fed to the parallel rollers and a crease is arranged in the stack of sheets. The knife blade is moved up to, but not through the nip of the parallel rollers.

To sharpen the crease in the folded stack of sheets, the stack could be fed to secondary rollers, which are pressed together under a higher force, than the first rollers. This increased force will sharpen the crease.

When feeding the stack of sheets through the primary and secondary rollers, each sheet is provided with a crease. However, depending on the number of sheets and position of the sheets relative to the center of the booklet, the crease is more or less sharp. The sheets near the center of the booklet have typically more sharp creases than the outer sheets. This is the result of the pressure arranged on the outside of the booklet and the resilience of the sheets.

The sharpness of the creases also depends on the friction between the sheets. If the sheets are provided with a glossy finish the friction between the sheets is low, resulting in less sharp creases.

A further option is to provide a so called square back fold. For such a fold a roller is run along the back, while the sides of the back are held by for example to pressing bars. This is known from GB2401820. However, the known square back techniques are only possible for booklet having at least some sheets of paper. A booklet with only one sheet cannot be provided with a square back fold by these known techniques.

It is an object of the invention to improve the knife folding technique.

SUMMARY OF THE INVENTION

This object is achieved with a folding machine according to the preamble, which is characterized by a transport plate having a leading edge around which the stack of sheets is folded, which transport plate is movable along the means for pre-folding and the means for finishing the fold.

The transport plate provides a means for transporting the folded sheets through the folding machine, but also provides an anvil for the folding pressure supplied to the sheets.

The transport plate is pushed, similar to a knife blade, against a stack of sheets to push the sheets between for example two parallel rollers to provide a pre-folding. The transport plate is however not retracted, but moves along with the pre-folded sheets. The transport plate is thus arranged in the center of a booklet, where it provides an anvil for the folding pressure supplied by the pre-folding means and finishing means.

In a preferred embodiment of the folding machine according to the invention, the means for finishing the fold comprise a back roller for pressing the fold between the back roller and the leading edge of the transport plate.

The back roller provides a square fold to the back of the booklet. This technique is known from for example U.S. Pat. No. 2,066,620. By using the transport plate as anvil, it is ensured that also the inner sheets of the booklets are provided with a square fold. Without the transport plate, the square fold gets less and less when one progresses to the inner sheets of the booklet.

The transport plate also makes it possible to provide a single sheet with a square fold. This is because the transport plate will function as an anvil around which the sheet is folded.

In another embodiment of the folding machine according to the invention the means for finishing the fold further comprise two side rollers arranged on either side of the transport plate.

The side rollers can provide a high local pressure to induce a crease in the sheets. The side rollers are moved along the length of the back of the booklet, such that the crease provided over the full length of the back of the booklet. In combination with a back roller, the side rollers also provide for a sharp fold.

The side rollers can also be provided with an additional rim to provide the outer sheets with an additional crease line.

In yet another preferred embodiment of the folding machine according to the invention the transport plate is flexible. In a co-pending application of the applicant, it is explained that the folding of sheets can be improved by inducing a meandering pattern to the back of the booklet. With a rigid transport plate, it would be impossible to induce a meandering pattering to the back.

The flexible plate could be made of spring steel. This will ensure that the meandering pattern can be induced, but also provide a firm base to function as an anvil for both the side rollers as the back roller.

In yet another embodiment of the folding machine according to the invention the leading edge of the transport plate comprises a bulge.

The bulge will increase the pressure on the inner sheets. Due to the bulge, the pressure is concentrated to a smaller portion of the sheets, such that the crease will be sharper.

Still another embodiment of the folding machine according to the invention comprises two endless belts arranged on either side of the transport plate for moving the transport plate along the means for pre-folding and the means for finishing the fold.

An endless belt, like a chain or plastic belt, is arranged according to the invention to both ends of the transport plate such that the transport plate can be moved between rollers and other parts of the folding machine.

Preferably, the means for pre-folding comprise two nip rollers. The nip rollers can pre-fold the sheets and also keep the pre-folded sheets in position for finishing the fold. Furthermore, the nip rollers also enable easy passage of the transport plate, whether it is arranged to endless belts or moved by other means.

These and other features of the invention will be elucidated in conjunction with the accompanying drawings.

DETAILED DESCRIPTION OF THE INVENTION

Figure 1:
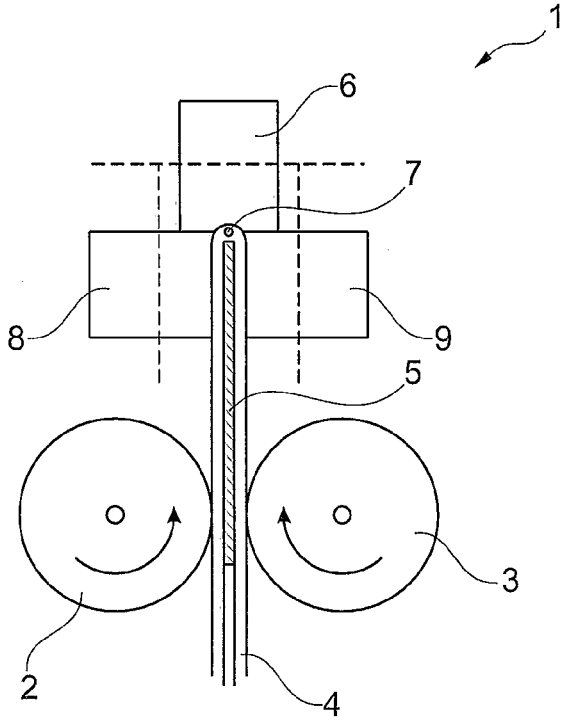
FIG. 1 shows a schematic cross sectional view of a first embodiment of the folding machine according to the invention.

FIG. 1 shows a schematic view of a folding machine 1 according to the invention. The folding machine 1 has two nip rollers 2, 3 for pre-folding a stack of sheets 4 around a transport plate 5. As illustrated in FIG. 1, the leading edge of the transport plate 5 abuts the fold.

The transport plate 5 moves the pre-folded sheets 4 along the nip rollers 2, 3. The nip rollers 2, 3 then keep the pre-folded sheets 4 in position, such that a back roller 6 can roll over the back 7 of the pre-folded sheets 4.

The transport plate 5 functions as an anvil, such that the back roller 6 can exert a large pressure to the back 7, such that a square fold is generated.

Side rollers 8, 9 are arranged on either side of the transport plate 5 to provide further pressure on the pre-folded sheets 4. This pressure is counter acted by the transport plate 5, such that also the inner portion of the pre-folded sheets 4 receive sufficient pressure to be creased.

Figure 2:
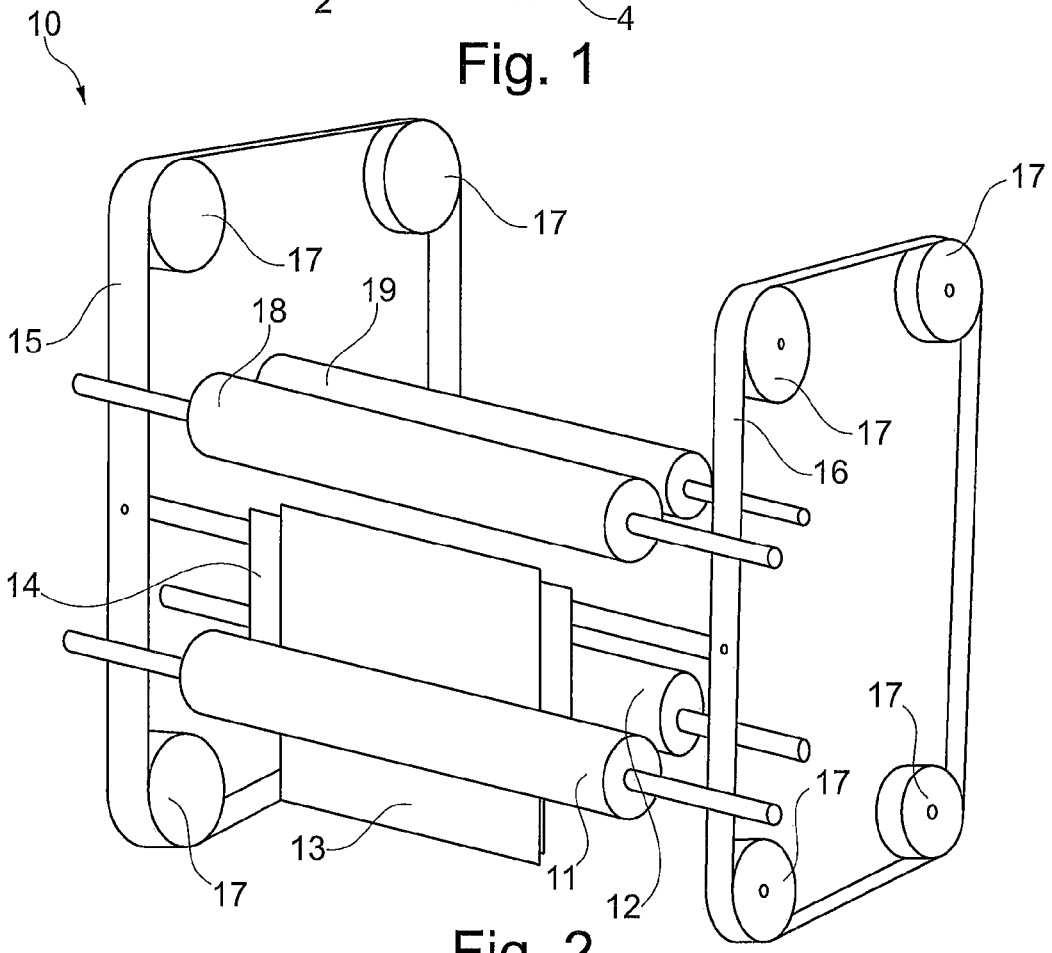
FIG. 2 shows a schematic perspective view of a second embodiment of the folding machine according to the invention.

FIG. 2 shows a second embodiment of a folding machine 10 according to the invention. This folding machine 10 has a set of primary rollers 11, 12, which provide a pre-folding action to a set of sheets 13 folded around a transport plate 14.

The transport plate 14 is connected to two endless belts 15, 16 positioned on either side of the transport plate 14. The belts 15, 16 are guided along guide rollers 17. From inspection of FIG. 2, it can be seen that, between guide rollers 17, the belts 15, 16 are aligned with the primary rollers 11, 12 wherein the belts 15, 16 position the transport plate 14 such that the transport plate 14 can be moved along with the sheets 13 through the primary rollers 11, 12.

After the pre-folding by the primary rollers 11, 12, the sheets 13 and the transport plate 14 is moved through secondary rollers 18, 19 to finish the fold in the sheets 13.

Figure 3:
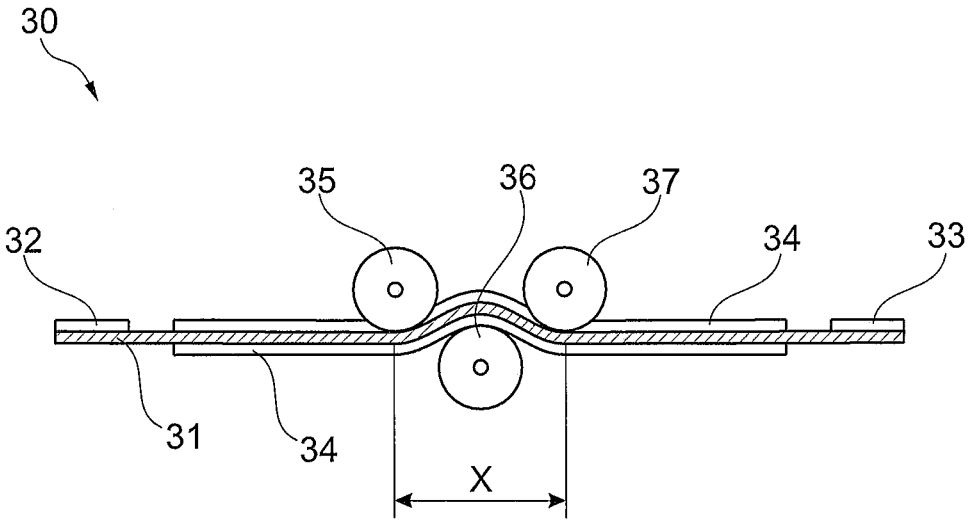
FIG. 3 shows a schematic cross sectional view of a third embodiment of the folding machine according to the invention.

FIG. 3 shows a third embodiment of a folding machine 30 according to the invention. In this embodiment, the transport plate 31 is flexible and arranged on either side to belts 32, 33.

A set of sheets 34 is folded around the transport plate 31. To finish the crease in the sheets, a meandering pattern is imposed over a length x to the back of the sheets 34. This meandering pattern is caused by three rollers 35, 36, 37 and facilitated by the flexibility of the transport plate 34.

Figure 4:
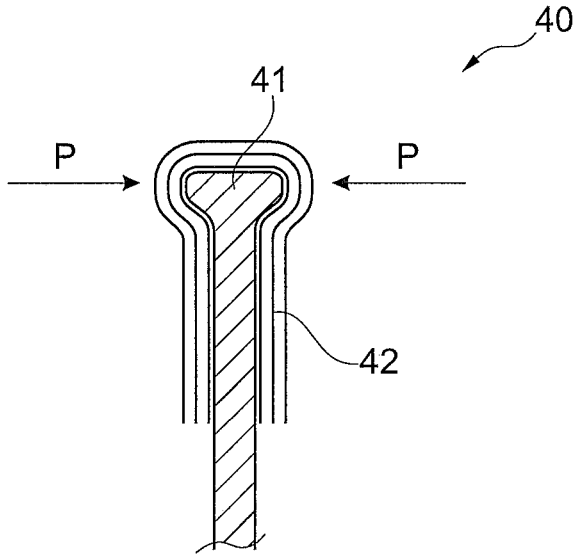
FIG. 4 shows a cross section of the transport plate of a fourth embodiment according to the invention.

FIG. 4 shows a cross section of the transport plate 40 of a fourth embodiment according to the invention.

The transport plate 40 is provided on the leading edge with a bulge 41. Sheets of paper 42 are folded around the transport plate 40. When a pressure P is supplied to the sheets of the paper 42, the protruding edges of the bulge 41 concentrate the pressure, such that also the inner sheets 42 are subjected to sufficient pressure for providing the desired fold.

The invention claimed is:

1. A folding machine for folding a stack of sheets, the folding machine comprising:

a frame;

means for pre-folding a stack of sheets along a crease line into a main plane such that a booklet with a straight back is obtained;

means for maintaining the shape of the pre-folded booklet relative to the frame;

means for finishing the fold;

a transport plate having a leading edge around which the stack of sheets is folded and wherein the leading edge is abutting the fold, said transport plate being movable with its leading edge abutting the fold along the means for pre-folding and the means for finishing the fold; and two endless belts with one belt arranged on each side of the transport plate, wherein the two endless belts are guided along guide rollers for pulling the transport plate along the means for pre-folding and then along the means for finishing the fold, wherein between guide rollers the two endless belts are aligned with the means for pre-folding the stack of sheets and wherein each of the endless belts defines a plane that is perpendicular to the transport plate to position the transport plate for movement along with the stack of sheets through the means for pre-folding the stack of sheets.

2. The folding machine according to claim 1, wherein the means for finishing the fold comprise a back roller for pressing the fold between the back roller and the leading edge of the transport plate.

3. The folding machine according to claim 1, wherein the means for finishing the fold further comprise two side rollers arranged on either side of the transport plate.

4. The folding machine according to claim 1, wherein the transport plate is flexible.

5. The folding machine according to claim 1, wherein the leading edge of the transport plate comprises a bulge.

6. The folding machine according to claim 1, wherein the means for pre-folding comprise two nip rollers.

* * * * *